US009808060B2

(12) United States Patent
Chiang

(10) Patent No.: US 9,808,060 B2
(45) Date of Patent: Nov. 7, 2017

(54) PULL HANDLE OF LUGGAGE

(71) Applicant: C & C Luggage Manufacturing Co., Ltd., Guangdong (CN)

(72) Inventor: Hsi-Wu Chiang, Guangdong (CN)

(73) Assignee: C & C Luggage Manufacturing Co., Ltd., Guangdong (CN)

( * ) Notice: Subject to any disclaimer, the term of this patent is extended or adjusted under 35 U.S.C. 154(b) by 48 days.

(21) Appl. No.: 14/986,340

(22) Filed: Dec. 31, 2015

(65) Prior Publication Data

US 2016/0338461 A1 Nov. 24, 2016

(30) Foreign Application Priority Data

May 22, 2015 (TW) ..... 104116357 A

(51) Int. Cl.
*A47B 95/02* (2006.01)
*A45C 13/26* (2006.01)

(52) U.S. Cl.
CPC ..... *A45C 13/262* (2013.01); *A45C 2013/267* (2013.01)

(58) Field of Classification Search
CPC . A45C 13/262; A45C 2013/267; A47B 95/02; B62B 1/125; B62B 2202/24
USPC ..... 16/113.1, 114.1, 405
See application file for complete search history.

(56) References Cited

U.S. PATENT DOCUMENTS 5,692,266 A * 12/1997 Tsai ..... A45C 13/262 16/113.1
5,729,866 A * 3/1998 Chg ..... A45C 13/262 16/405
5,875,520 A * 3/1999 Chang ..... A45C 13/262 16/405
6,128,806 A * 10/2000 Shou-Mao ..... A45C 13/262 16/113.1
6,161,253 A * 12/2000 Tu ..... A45C 13/262 16/113.1
6,223,392 B1 * 5/2001 Chang ..... A45C 13/262 16/113.1
6,295,698 B1 * 10/2001 Chang ..... A45C 13/262 16/113.1
6,550,102 B1 * 4/2003 Liang ..... A45C 13/262 16/113.1
6,918,475 B2 * 7/2005 Lin ..... A45C 13/262 16/113.1
8,214,972 B2 * 7/2012 Lai ..... A45C 13/262 16/113.1
2003/0024071 A1 * 2/2003 Wang ..... A45C 13/262 16/113.1

(Continued)

*Primary Examiner* — Roberta Delisle
(74) *Attorney, Agent, or Firm* — Muncy, Geissler, Olds & Lowe, P.C.

(57) ABSTRACT

A pull handle of a luggage, which is adapted for accommodating a control device having a button, includes a main body and a cover. The main body has a transverse pipe, two vertical pipes integrally extended from two ends of the transverse pipe respectively, and a hollow portion located at the transverse pipe. The cover is mounted to the main body and covers at least one part of the hollow portion. The cover and the transverse pipe constitute a grip which has an opening corresponding in position to the button of the control device. In this way, the pull handle is not only firm in structure so as to be uneasily damaged and have long life time, but also simplified in assembling process.

8 Claims, 5 Drawing Sheets

(56) References Cited

U.S. PATENT DOCUMENTS

2006/0191103 A1* 8/2006 Wu ..... A45C 13/26
16/113.1
2010/0088848 A1* 4/2010 Chiang ..... A45C 13/262
16/113.1

* cited by examiner

PULL HANDLE OF LUGGAGE

BACKGROUND OF THE INVENTION

1. Field of the Invention

The present invention relates to pull handles and more particularly, to a pull handle of a luggage.

2. Description of the Related Art

A conventional pull handle of a luggage primarily includes a grip, and two straight rods installed at two ends of the grip, respectively. A button is located on the pull handle to enable the pull handle to be stuck out or retracted into the case of the luggage by the user according to the usage requirements. However, after the luggage is used for a long time, the grip is liable to be separated from the two straight rods because the grip and the straight rods are not connected firm enough. For example, if the luggage is carelessly transported in the airport or knocks against other luggage in the shipping process, or the weight of the case of the luggage exceeds the highest weight the pull handle can bear, the pull handle is liable to be separated or damaged.

SUMMARY OF THE INVENTION

The present invention has been accomplished in view of the above-noted circumstances. It is an objective of the present invention to provide a pull handle of a luggage, which is firm in structure so as to be uneasily damaged, and simplified in the assembling process.

To attain the above objective, the present invention provides a pull handle of a luggage, which is adapted for accommodating a control device having a button. The pull handle includes a main body and a cover. The main body has a transverse pipe, two vertical pipes integrally extended from two ends of the transverse pipe respectively, and a hollow portion located at the transverse pipe. The cover is mounted to the main body and covers at least one part of the hollow portion. The cover and the transverse pipe constitute a grip which has an opening corresponding in position to the button of the control device.

The main body of the pull handle is made integrally, so it doesn't need to be assembled, thereby easy in manufacturing. Besides, the pull handle is firm in structure so as to be uneasily damaged and extend the life time of the luggage.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
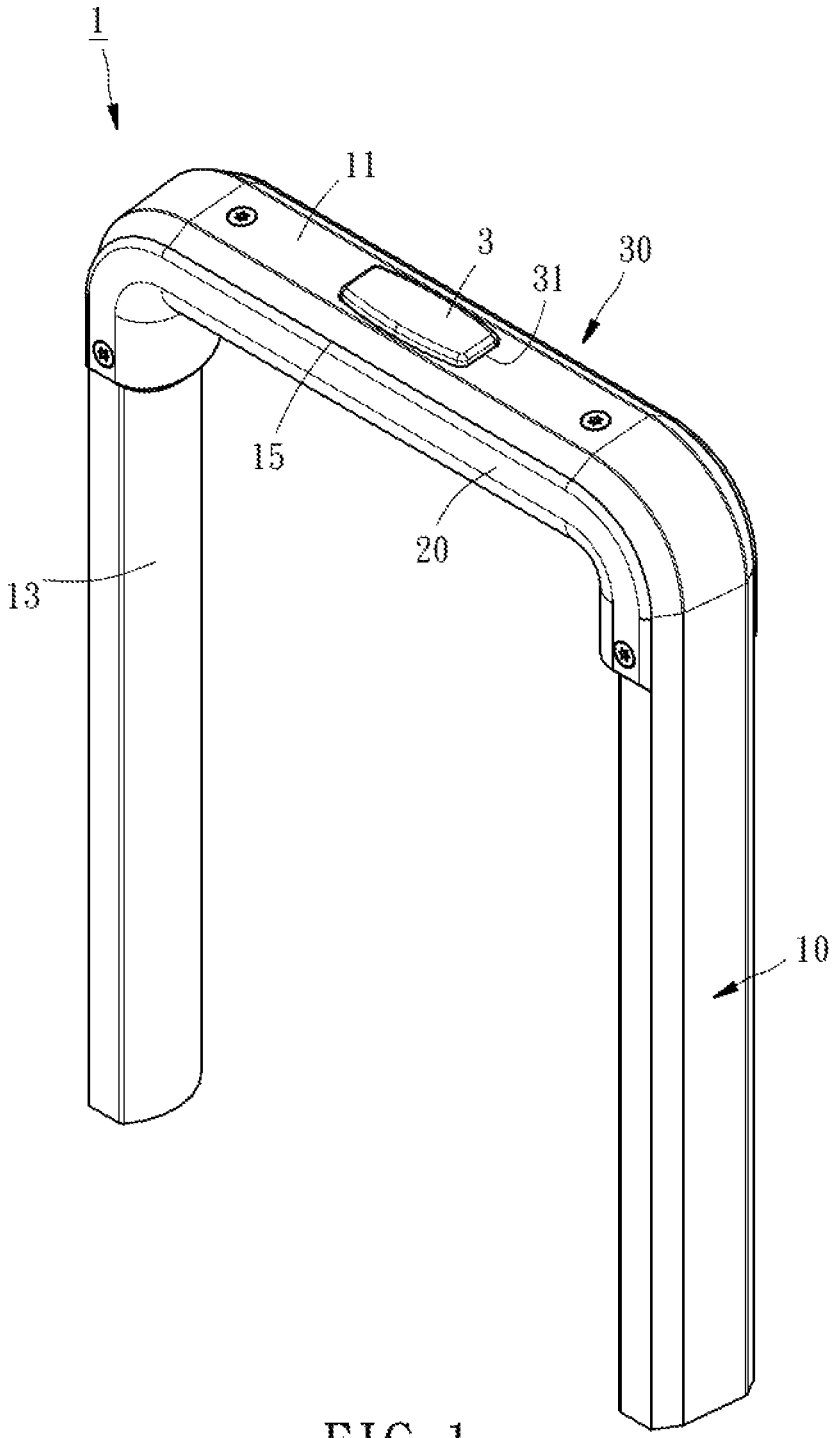
FIG. 1 is an assembled perspective view of a first embodiment of the present invention.
Figure 2:
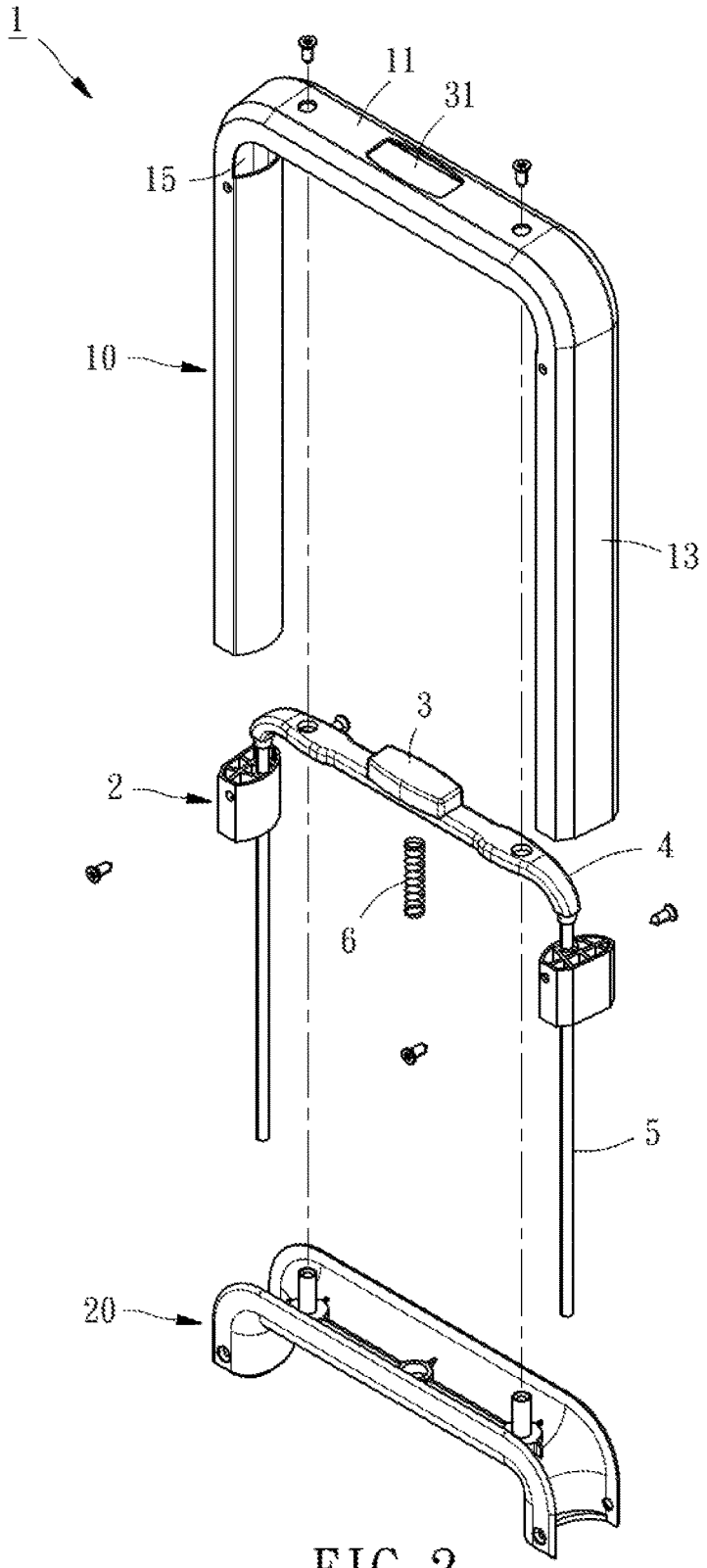
FIG. 2 is an exploded perspective view of the first embodiment of the present invention.
Figure 3:
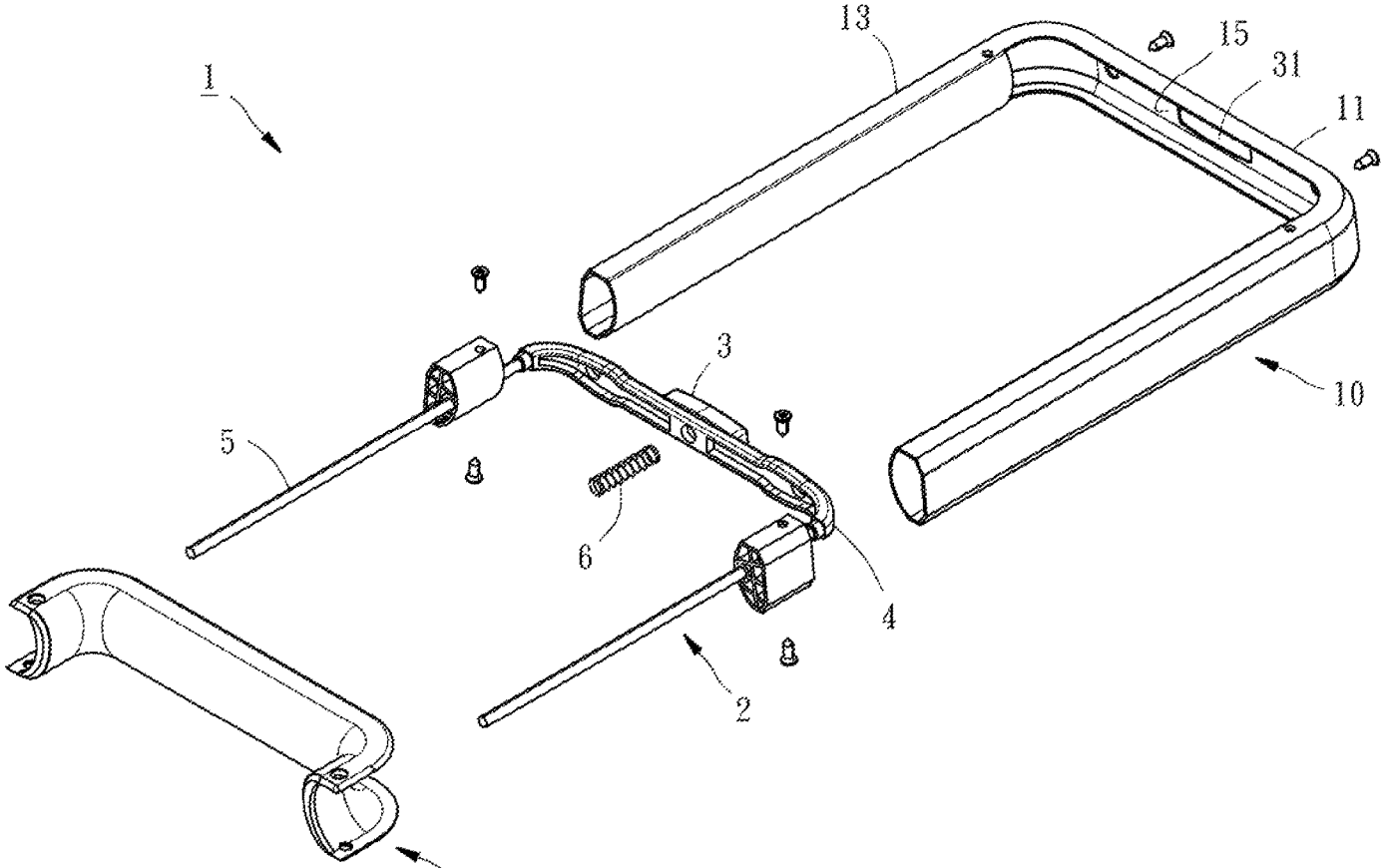
FIG. 3 is another exploded perspective view of the first embodiment of the present invention.

Referring to FIGS. 1-3, a pull handle 1 of a luggage according to a first embodiment of the present invention is adapted for accommodating a control device 2. The control device 2 has a button 3, a base 4 attached to the bottom of the button 3, two connecting rods 5 extended downwardly from two ends of the base 4, and a compressive spring 6 disposed under the base 4. The pull handle 1 includes a main body 10 and a cover 20.

The main body 10 has a transverse pipe 11, two vertical pipes 13 integrally extended downwardly from two ends of the transverse pipe 11 respectively, and a hollow portion 15 located at the downside of the transverse pipe 11 and extended to the inner sides of the two vertical pipes 13. The main body 10 may, but not limited to, be made of aluminum, aluminum alloy, or stainless steel. The transverse pipe 11 is adapted for accommodating the base 4 and the compressive spring 6 of the control device 2, and the two vertical pipes 13 are adapted for accommodating the two connecting rods 5. The bottom ends of the two vertical pipes 13 may be inserted into two sleeves (not shown) to constitute telescopic rods capable of being lengthened and shortened. The bottom ends of the two connecting rods 5 are connected with a lock mechanism (not shown), so that the user can control the lock mechanism to lock or release the telescopic rods by pressing the button 3. When the telescopic rods are locked, the two vertical pipes 13 are immovable relative to the two sleeves, so that the telescopic rods can't be lengthened or shortened. When the telescopic rods are released, the two vertical pipes 13 are movable relative to the two sleeves, so that the telescopic rods can be lengthened or shortened.

The cover 20 is mounted to the main body 10 and covers at least one part of the hollow portion 15, so that the cover 20 and the transverse pipe 11 of the main body 10 constitute a grip 30. The grip 30 has an opening 31 corresponding in position to the button 3 of the control device 2. In this embodiment, the hollow portion 15 is completely covered by the cover 20, the opening 31 is located at the upside of the transverse pipe 11 of the main body 10, and the button 3 is protruded out of the opening 31. The compressive spring 6 is disposed between the cover 20 and the base 4 to provide an upward force, so that the button 3 is protruded out of the opening 31 when receiving no external force.

The main body 10 and the cover 20 can be combined together by some fastening elements such as screws or bolts, or by other connecting ways. Because the main body 10 of the pull handle 1 is made integrally, it doesn't need to be assembled so as to simplify the assembling process of the pull handle. Besides, the pull handle 1 is firm in structure so as to be more uneasily damaged than the conventional pull handles, thereby extending the life time of the luggage. In the process of manufacturing the main body 10, a straight pipe is made by aluminum extrusion, partially removed to form the hollow portion 15, and then bended to become the main body 10. The hollow portion 15 makes the straight pipe more easily bended to become the main body 10, and the control device 2 can be installed into the main body 10 through the hollow portion 15.

Figure 4:
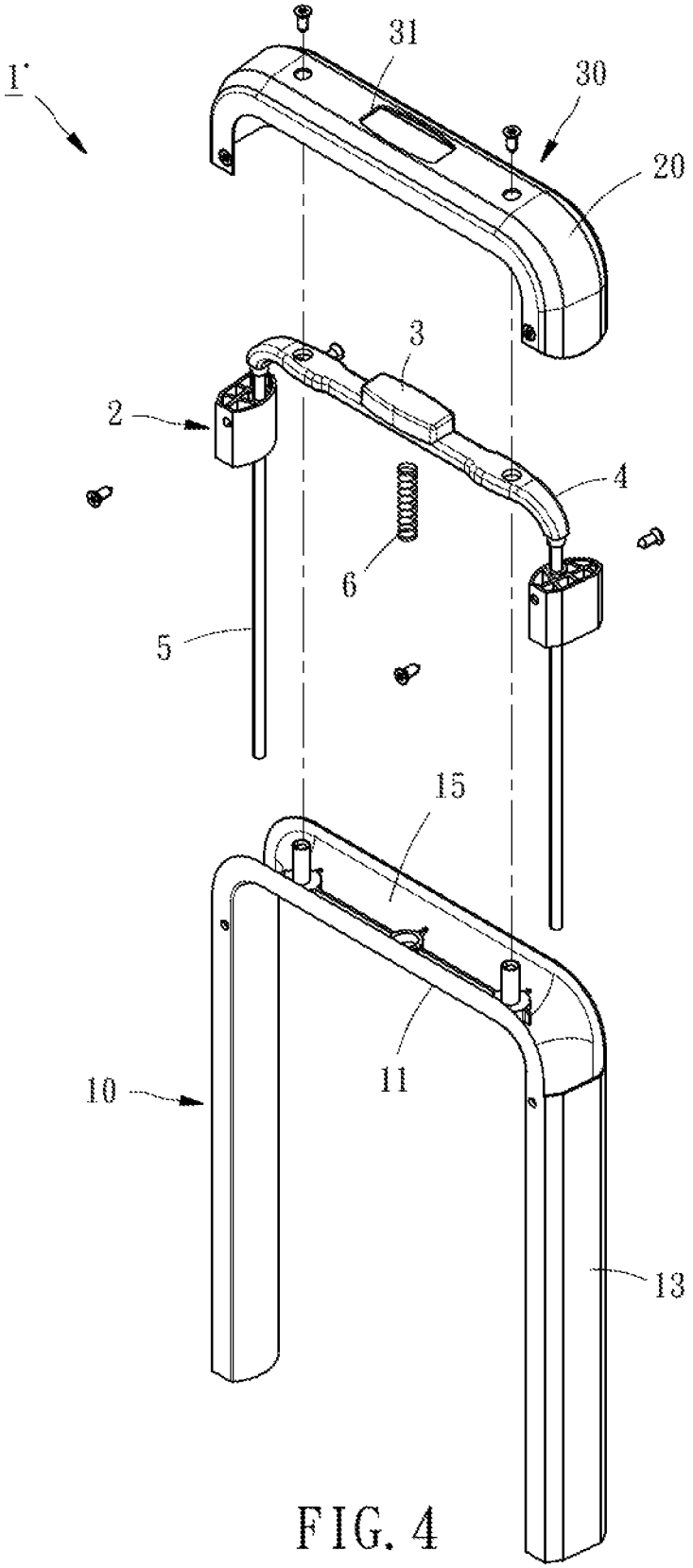
FIG. 4 is an exploded perspective view of a second embodiment of the present invention.
Figure 5:
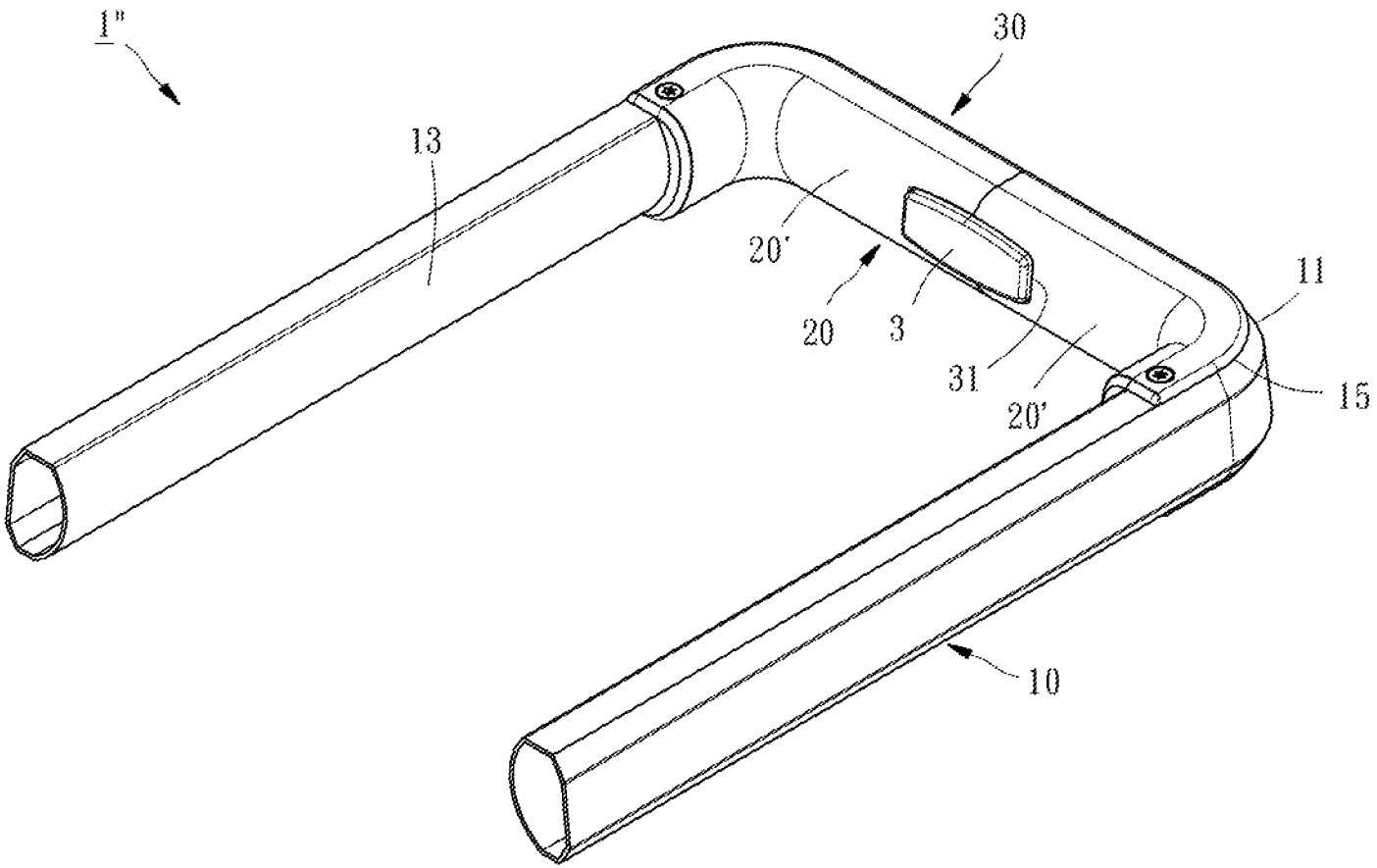
FIG. 5 is an assembled perspective view of a third embodiment of the present invention.

In other embodiments, the hollow portion 15 may be only located at the transverse pipe 11 of the main body 10 without extending to the two vertical pipes 13. Alternately, the hollow portion 15 may be located at other positions of the main body 10. For example, in the pull handle 1' according to a second embodiment as shown in FIG. 4, the hollow portion 15 is located at the upside of the transverse pipe 11, and may be further extended to the outer sides of the two vertical pipes 13. The cover 20 is mounted to the main body 10 and covers the hollow portion 15, and the opening 31 is located at the cover 20. Another example is a pull handle 1" according to a third embodiment as shown in FIG. 5, wherein the cover 20 is composed of two cover pieces 20'. The opening 31 is a part of the hollow portion 15 of the main body 10, which is not covered by the cover 20. This means the opening 31 is the uncovered part of the hollow portion 15 located at the juncture of the two cover pieces 20'. The button 3 of the control device 2 is protruded out of the opening 31. However, the button 3 may be configured to be not protruded out of the opening 31, depending on the usage requirements.

In conclusion, based on the spirit of the present invention, the hollow portion may be located at the upside, downside or other positions of the transverse pipe of the main body, and completely or partially covered by the cover; the opening may be located at the transverse pipe or the cover. Because the transverse pipe and the two vertical pipes are made integrally, the pull handle of the present invention has great structural strength and long life time. The above description represents merely the preferred embodiments of the present invention, without any intention to limit the scope of the present invention. The simple variations and modifications not to be regarded as a departure from the spirit of the invention are intended to be included within the scope of the following claims.

What is claimed is:

1. A pull handle of a luggage, which is adapted for accommodating a control device (2) having a button (3), the pull handle comprising:

a main body (10) having a transverse pipe (11), two vertical pipes (13) monolithically extended from two ends of the transverse pipe (11) respectively, and a hollow portion (15) located at the transverse pipe (11); and a cover (20) mounted to the main body (10) and covering at least one part of the hollow portion (15), the cover (20) and the transverse pipe (11) constituting a grip (30) which has an opening (31) corresponding in position to the button (3) of the control device (2).

2. The pull handle of the luggage as claimed in claim 1, wherein the hollow portion (15) is extended from the transverse pipe (11) to the two vertical pipes (13).

3. The pull handle of the luggage as claimed in claim 2, wherein the hollow portion (15) is located at a downside of the transverse pipe (11) and inner sides of the two vertical pipes (13).

4. The pull handle of the luggage as claimed in claim 2, wherein the hollow portion (15) is located at an upside of the transverse pipe (11) and outer sides of the two vertical pipes (13).

5. The pull handle of the luggage as claimed in claim 1, wherein the opening (31) is located at the transverse pipe (11) of the main body (10).

6. The pull handle of the luggage as claimed in claim 1, wherein the opening (31) is located at the cover (20).

7. The pull handle of the luggage as claimed in claim 1, wherein the opening (31) is a part of the hollow portion (15) of the main body (10), which is not covered by the cover (20).

8. The pull handle of the luggage as claimed in claim 1, wherein the main body (10) is made of aluminum, aluminum alloy, or stainless steel.

* * * * *